US007352263B2

(12) United States Patent
Pance et al.

(10) Patent No.: US 7,352,263 B2
(45) Date of Patent: Apr. 1, 2008

(54) METHOD AND MECHANISM FOR TUNING DIELECTRIC RESONATOR CIRCUITS

(75) Inventors: Kristi Dhimiter Pance, Auburndale, MA (US); Eswarappa Channabasappa, Acton, MA (US)

(73) Assignee: M/A-Com, Inc., Lowell, MA (US)

( * ) Notice: Subject to any disclaimer, the term of this patent is extended or adjusted under 35 U.S.C. 154(b) by 0 days.

(21) Appl. No.: 11/413,247

(22) Filed: Apr. 28, 2006

(65) Prior Publication Data

US 2006/0197631 A1 Sep. 7, 2006

Related U.S. Application Data

(62) Division of application No. 10/799,976, filed on Mar. 12, 2004, now abandoned.

(51) Int. Cl.
*H01P 7/10* (2006.01)

(52) U.S. Cl. ..... 333/202; 333/219.1

(58) Field of Classification Search ..... 333/202, 333/219.1, 232, 212, 235
See application file for complete search history.

(56) References Cited

U.S. PATENT DOCUMENTS

| | | | | |
|---|---|---|---|---|
| 3,475,642 A | | 10/1969 | Karp et al. | 315/3.5 |
| 4,028,652 A | | 6/1977 | Wakino et al. | 333/73 W |
| 4,138,652 A | | 2/1979 | Nishikawa et al. | 333/82 R |
| 4,241,322 A | * | 12/1980 | Johnson et al. | 333/202 |
| 4,267,537 A | | 5/1981 | Karmel | 393/321 |
| 4,283,649 A | | 8/1981 | Heinouchi | 310/324 |
| 4,423,397 A | | 12/1983 | Nishikawa et al. | 333/202 |
| 4,459,570 A | | 7/1984 | Delaballe et al. | 333/202 |
| 4,477,785 A | | 10/1984 | Atia | 333/202 |
| 4,578,655 A | | 3/1986 | Etienne et al. | 333/202 |
| 4,620,168 A | | 10/1986 | Delestre et al. | 333/202 |

(Continued)

FOREIGN PATENT DOCUMENTS

DE 42 41 027 A1 6/1994

(Continued)

OTHER PUBLICATIONS

Hui et al. "Dielectric Ring-Gap Resonator for Application in MMIC's" IEEE Transactions on Microwave Theory and Techniques vol. 39, No. 12, Nov. 1991, pp. 2061-2068.

(Continued)

*Primary Examiner*—Seungsook Ham

(57) ABSTRACT

The invention comprises a technique and associated mechanisms by which dielectric resonator circuits, such as filters, can be tuned in both frequency, bandwidth or both without the need for irises, tuning screws and/or tuning plates. In accordance with the invention, the positions of the dielectric resonators are adjustable relative to each other within the cavity in multiple ways, including vertically and horizontally. The dielectric resonators also may tilt relative to each other. Furthermore, an off-center longitudinal hole can be machined in one or more of the dielectric resonators so as to make the electromagnetic field of the resonator non-uniform so that the dielectric resonator can be rotated about its longitudinal axis to alter the coupling between dielectric resonators. In accordance with another aspect of the invention, frequency tuning can be accomplished by using two separate dielectric resonators adjacent each other, one on top of the other, and adjusting the vertical spacing therebetween to achieve the desired center frequency within that dielectric resonator pair.

8 Claims, 13 Drawing Sheets

U.S. PATENT DOCUMENTS

| | | | | |
|---|---|---|---|---|
| 4,661,790 | A | 4/1987 | Gannon et al. | 333/234 |
| 4,757,289 | A | 7/1988 | Kosugi et al. | 333/209 |
| 4,810,984 | A | 3/1989 | Arnold et al. | 333/202 |
| 4,821,006 | A | 4/1989 | Ishikawa et al. | 333/202 |
| 4,835,498 | A | 5/1989 | Rouger et al. | 333/205 |
| 4,881,051 | A | 11/1989 | Tang et al. | 333/208 |
| 5,059,929 | A | 10/1991 | Tanaka | 333/219.1 |
| 5,109,207 | A | 4/1992 | Aizawa et al. | 333/222 |
| 5,140,285 | A | 8/1992 | Cohen | 331/96 |
| 5,218,330 | A | 6/1993 | Omiya et al. | 333/223 |
| 5,347,246 | A | 9/1994 | Bellows et al. | 333/219 |
| 5,525,945 | A | 6/1996 | Chiappetta et al. | 333/202 |
| 5,614,876 | A | 3/1997 | Takahashi et al. | 333/204 |
| 5,691,677 | A | 11/1997 | De Maron et al. | 333/219.1 |
| 5,748,058 | A | 5/1998 | Scott | 333/202 |
| 5,777,534 | A | 7/1998 | Harrison | 333/202 |
| 5,841,330 | A | 11/1998 | Wenzel et al. | 333/202 |
| 5,859,574 | A | 1/1999 | Schmitt | 333/202 |
| 5,949,309 | A | 9/1999 | Correa | 333/202 |
| 5,990,767 | A | 11/1999 | Ivanov et al. | 333/219.1 |
| 6,087,910 | A | 7/2000 | Matsumoto et al. | |
| 6,100,703 | A | 8/2000 | Davidov et al. | |
| 6,111,339 | A | 8/2000 | Ohya et al. | 310/358 |
| 6,208,227 | B1 | 3/2001 | Remillard et al. | 333/219 |
| 6,254,708 | B1 | 7/2001 | Cappabianca | |
| 6,262,639 | B1 | 7/2001 | Shu et al. | |
| 6,337,664 | B1 | 1/2002 | Mayes et al. | |
| 6,402,981 | B1 | 6/2002 | Sasaki | 252/62.9 PZ |
| 6,707,353 | B1 | 3/2004 | Yamakawa et al. | 333/202 |
| 6,717,490 | B1 | 4/2004 | Mayer | |
| 6,784,768 | B1 | 8/2004 | Pance et al. | 333/219 |
| 2004/0051602 | A1 | 3/2004 | Pance et al. | 333/202 |
| 2004/0051603 | A1 | 3/2004 | Pance et al. | 333/202 |

FOREIGN PATENT DOCUMENTS

| | | | |
|---|---|---|---|
| EP | 0 492304 | A1 | 7/1992 |
| EP | 0 601 370 | A1 | 6/1994 |
| EP | 1 162 684 | A3 | 12/2001 |
| EP | 1 181 740 | B1 | 3/2003 |
| EP | WO 2004/027917 | A2 | 4/2004 |
| GB | 1 376 938 | | 11/1974 |
| GB | 1 520 473 | | 9/1978 |
| JP | 57-014202 | A | 1/1982 |
| JP | 59-202701 | | 11/1984 |
| JP | 363280503 | A | 11/1988 |
| JP | 01-144701 | | 7/1989 |
| JP | 02-042898 | A | 2/1990 |
| JP | 02-137502 | | 5/1990 |
| JP | 02-168702 | | 6/1990 |
| JP | 05-102714 | | 4/1993 |
| JP | 05-267940 | | 10/1993 |
| JP | 06-061714 | | 3/1994 |
| JP | 07-154114 | A | 6/1995 |
| JP | 07-154116 | | 6/1995 |
| JP | 03-249803 | | 9/2003 |
| WO | WO 00/70706 | | 11/2000 |
| WO | WO 01/43221 | | 6/2001 |

OTHER PUBLICATIONS

D. Kajfez and P. Guillon "Dielectric Resonators", ISBN 0-89006-201-3, Publisher Artech House, Dedham, NA 1986, pp. 298-317.

E. J. Heller, "Quantum Proximity Resonances", Physical Review Letter, vol. 77, No. 20, Nov. 11, 1966 The American Physical Society, pp. 4122-4125.

K. Pance et al., "Tunnelling Proximity Resonances: Interplay Between Symmetry and Dissipation" Physics Department, Northwestern University Aug. 2, 199, T-143, pp. 16-18, F426.

J. S. Hersch, et al. "Observation of Proximity Resonances in a Patellel-Plate Waveguide" Physical Review Letters, vol. 81, No. 15, Oct. 12, 1998 The American Physical Society, pp. 3059-3061.

Gerdine, "A Frequency-Stabilized Microwave Band-Rejection Filter Using High Dielectric Constant Resonators", IEEE Trans. On Microwave Theory & Techniques, vol. MTT-17, No. 7, Jul. 1969, pp. 354-359.

Verdeyme et al., "New Direct Coupling Configuration Between TE01 Dielectric Resonator Modes", Electronics Letters, vol. 25, No. 11, May 25, 1989, pp. 693-694.

Kishk et al., "Conical Dielectric Resonator Antennas for Wide-Band Applications," IEEE Transactions on Antennas and Propogation, 50(4); 469-474 (2002).

T. Nishikawa et al., "Dielectric High-Power Bandpass Filter Using Quarter-Cut $TE_{01o}$ Image Resonator for Cellular Base Stations", IEEE Transactions on Microwave Theory and Techniques, vol. MTT-35, No. 12, Dec. 1987, pp. 1150-1155.

Machine Translation for Foreign patent document number DE 42 41 027 A1, Publication date Jun. 9, 1994, Applicant ANT Nachrichtentechnik.

* cited by examiner

METHOD AND MECHANISM FOR TUNING DIELECTRIC RESONATOR CIRCUITS

CROSS REFERENCE

This application is a division of application Ser. No. 10/799,976, filed Mar. 12, 2004, now abandoned which is herein fully incorporated by reference.

FIELD OF THE INVENTION

The invention pertains to dielectric resonator circuits and, particularly, dielectric resonator filters. More particularly, the invention pertains to techniques for tuning such circuits in bandwidth and in frequency.

BACKGROUND OF THE INVENTION

Dielectric resonators are used in many circuits for concentrating electric fields. They are commonly used as filters in high frequency wireless communication systems, such as satellite and cellular communication applications. They can be used to form oscillators, triplexers and other circuits, in addition to filters.

FIG. 1 is a perspective view of a typical dielectric resonator of the prior art. As can be seen, the resonator 10 is formed as a cylinder 12 of dielectric material with a circular, longitudinal through hole 14. FIG. 2 is a perspective view of a microwave dielectric resonator filter 20 of the prior art employing a plurality of dielectric resonators 10. The resonators 10 are arranged in the cavity 22 of a conductive enclosure 24. The conductive enclosure 24 typically is rectangular. The enclosure 24 commonly is formed of aluminum and is silver-plated, but other materials also are well known. The resonators 10 may be attached to the floor of the enclosure, such as by an adhesive, but also may be suspended above the floor of the enclosure by a low-loss dielectric support, such as a post or rod.

Microwave energy is introduced into the cavity by an input coupler 28 coupled to an input energy source through a conductive medium, such as a coaxial cable. That energy is electromagnetically coupled between the input coupler and the first dielectric resonator. Coupling may be electric, magnetic or both. Conductive separating walls 32 separate the resonators from each other and block (partially or wholly) coupling between physically adjacent resonators 10. Particularly, irises 30 in walls 32 control the coupling between adjacent resonators 10. Walls without irises generally prevent any coupling between adjacent resonators separated by those walls. Walls with irises allow some coupling between adjacent resonators separated by those walls. By way of example, the dielectric resonators 10 in FIG. 2 electromagnetically couple to each other sequentially, i.e., the energy from input coupler 28 couples into resonator 10*a*, resonator 10*a* couples with the sequentially next resonator 10*b* through iris 30*a*, resonator 10*b* couples with the sequentially next resonator 10*c* through iris 30*b*, and so on until the energy is coupled from the sequentially last resonator 10*d* to the output coupler 40. Wall 32*a*, which does not have an iris, prevents the field of resonator 10*a* from coupling with physically adjacent, but not sequentially adjacent, resonator 10*d* on the other side of the wall 32*a*. Dielectric resonator circuits are known in which cross coupling between non-sequentially adjacent resonators is desirable and is, therefore, allowed and/or caused to occur. However, cross-coupling is not illustrated in the exemplary dielectric resonator filter circuit shown in FIG. 2.

An output coupler 40 is positioned adjacent the last resonator 10*d* to couple the microwave energy out of the filter 20. Signals also may be coupled into and out of a dielectric resonator circuit by other techniques, such as microstrips positioned on the bottom surface 44 of the enclosure 24 adjacent the resonators.

Generally, both the bandwidth and the center frequency of the filter must be set very precisely.

As part of the process of fine tuning such circuits, one or more metal plates 42 may be attached to a top cover plate (the top cover plate is not shown) generally coaxially with a corresponding resonator 10 to affect the field of the resonator in order to help set the center frequency of the filter. Particularly, plate 42 may be mounted on a screw 43 passing through a threaded hole in the top cover plate (not shown) of enclosure 24. The screw may be rotated to vary the spacing between the plate 42 and the resonator 10 to adjust the center frequency of the resonator.

In addition, tuning screws may be positioned in the irises between the adjacent resonators to affect the coupling between the resonators in order to tune the bandwidth of the filter.

The frequency and bandwidth of a dielectric resonator circuit depends on a great many factors. The sizes of the resonators 10, their relative spacing, the number of resonators, the size of the cavity 22, the sizes and positions of the tuning plates, the sizes and shapes of the irises 30, and the sizes, shapes, and positions of the tuning screws all need to be very precisely controlled to set the desired center wavelength and bandwidth of the filter.

As is well known in the art, dielectric resonators and dielectric resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is normally the transverse electric field mode, $TE_{01}$ (or TE hereinafter). Typically, the fundamental TE mode is the desired mode of the circuit or system in which the resonator is incorporated. The second-lowest-frequency mode typically is the hybrid mode, $H_{11}$ (or $H_{11}$ hereinafter). The $H_{11}$ mode is excited from the dielectric resonator, but a considerable amount of electric field lies outside of the resonator and, therefore, is strongly affected by the cavity. The $H_{11}$ mode is the result of an interaction of the dielectric resonator and the cavity within which it is positioned (i.e., the enclosure) and has two polarizations. The $H_{11}$ mode field is orthogonal to the TE mode field. Some dielectric resonator circuits are designed so that the $H_{11}$ mode is the fundamental mode. For instance, in dual mode filters, in which there are two signals at different frequencies, it is known to utilize the two polarizations of the $H_{11}$ mode for the two signals.

There are additional higher order modes, including the $TM_{01}$ mode, but they are rarely, if ever, used and essentially constitute interference. Typically, all of the modes other than the TE mode (or $H_{11}$ mode in filters that utilize that mode) are undesired and constitute interference.

The conventional techniques and mechanisms for tuning the frequency and/or bandwidth of dielectric resonator filters and other circuits have many shortcomings. For instance, the bandwidth of a dielectric resonator filter is a function of the field coupling between the individual dielectric resonators in the filter. The coupling between the dielectric resonators, and thus the bandwidth of the circuit, is primarily controlled by the size and shape of the irises between the resonators and the size and shape of the tuning screws positioned within the irises. The size and shape of the cavity also affects the bandwidth. Bandwidth tuning by adjusting the irises, tuning screws, and cavity is, largely, a process of trial and error and is tedious and labor-intensive and often consumes weeks. Particularly, each iteration of the trial and error process requires that the filter circuit be returned to a machine shop for re-machining of the cavity, irises, and/or tuning screws to new dimensions.

In addition, the tuning process involves very small and/or precise adjustments in the sizes and shapes of the irises, tuning screws and cavity. Thus, the machining process itself is expensive and error-prone.

Furthermore, the walls within which the irises are formed, the tuning screws and even the cavity all create losses to the system, decreasing the quality factor, Q, of the system and increasing the insertion loss of the system. Q essentially is an efficiency rating of the system and, more particularly, is the ratio of stored energy to lost energy in the system. The portions of the fields generated by the dielectric resonators that exist outside of the dielectric resonators touch all of the conductive components of the system, such as the enclosure 20, tuning plates 42, internal walls 32 and 34, and tuning screws 43, and inherently generate currents in those conductive elements. Field singularities exist at any sharp corners or edges of conductive components that exist in the electromagnetic fields of the filter. Any such singularities increase the insertion loss of the system, i.e., reduces the Q of the system. Thus, while the iris walls and tuning screws are necessary for tuning, they are the cause of loss of energy within the system.

Another disadvantage of the use of tuning screws within the irises is that such a technique does not permit significant changes in coupling strength between the dielectric resonators. Tuning screws typically provide tunability of not much more than 1 or 2 percent change in bandwidth in a typical communication application, where the bandwidth of the signal is commonly about 1 percent of the carrier frequency. For example, it is not uncommon in a wireless communication system to have a 20 MHz bandwidth signal carried on a 2000 MHz carrier. It would be very difficult using tuning screws to adjust the bandwidth of the signal to much greater than 21 or 22 MHz.

Even furthermore, it is difficult to implement cross-coupling between multiple dielectric resonators using the aforementioned conventional tuning techniques.

It is an object of the present invention to provide an improved dielectric resonator circuit.

It is another object of the present invention to provide a dielectric resonator filter circuit.

It is a further object of the present invention to provide improved mechanisms and techniques for tuning the center frequency of dielectric resonator circuits.

It is yet another object of the present invention to provide improved mechanisms and techniques for tuning the bandwidth of dielectric resonator circuits.

SUMMARY OF THE INVENTION

The invention comprises a technique and associated mechanisms for implementing the technique by which dielectric resonator circuits, such as filters, can be tuned in both frequency and bandwidth without the need for irises, tuning screws, and/or tuning plates. This helps to substantially reduce insertion loss and improve Q in the circuit because of the elimination of conductive components within the fields of the dielectric resonators.

In accordance with the invention, the positions of the dielectric resonators (or at least some of them) are adjustable relative to each other within the cavity in multiple ways, including vertically (i.e., along the longitudinal axes of the dielectric resonators) and horizontally (i.e., transverse the longitudinal axes of the dielectric resonators). The dielectric resonators can be positioned relative to each other so that they overlap in the vertical dimension. In accordance with another aspect of the invention, the dielectric resonators further can be selectively tilted relative to each other. This technique is particularly useful in dual mode dielectric resonator circuits in which an iris can be provided between adjacent resonators and the dielectric resonators can be tilted in the vertical plane transverse to the plane of the iris.

In accordance with another aspect of the invention, an off-center longitudinal hole can be machined into one or more of the dielectric resonators so as to make the electromagnetic field outside of the dielectric resonator non-uniform. With this irregularity on the dielectric resonator, the coupling between dielectric resonators can be even further adjusted by rotation of the resonators about their longitudinal axes.

In accordance with another aspect of the invention, frequency tuning can be accomplished by, instead of using a single dielectric resonator per pole, using two separate dielectric resonators adjacent each other, one on top of the other, and adjusting the vertical spacing therebetween to achieve the desired center frequency of that dielectric resonator pair. Then, the coupling between adjacent dielectric resonator pairs can be adjusted in order to adjust the bandwidth of the filter in any of the aforementioned ways, including vertical adjustment, horizontal adjustment, tilting, rotating about the vertical axis if a non-central longitudinal hole is provided in the dielectric resonators.

DETAILED DESCRIPTION OF THE INVENTION

Conical Resonators and Circuits Using Them

U.S. patent application Ser. No. 10/268,415, which is fully incorporated herein by reference, discloses new dielectric resonators as well as circuits using such resonators. One of the key features of the new resonators disclosed in the aforementioned patent application is that the field strength of the TE mode field outside of and adjacent the resonator varies along the longitudinal dimension of the resonator. As disclosed in the aforementioned patent application, a key feature of these new resonators that helps achieve this goal is that the cross-sectional area of the resonator measured parallel to the field lines of the TE mode varies along the longitude of the resonator, i.e., perpendicular to TE mode field lines. In preferred embodiments, the cross-section varies monotonically as a function of the longitudinal dimension of the resonator. In one particularly preferred embodiment, the resonator is conical, as discussed in more detail below. Even more preferably, the cone is a truncated cone.

Figure 1:
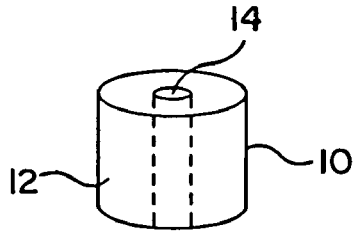
FIG. 1 PRIOR ART
FIG. 1 is a perspective view of a cylindrical dielectric resonator in accordance with the prior art.
Figure 2:
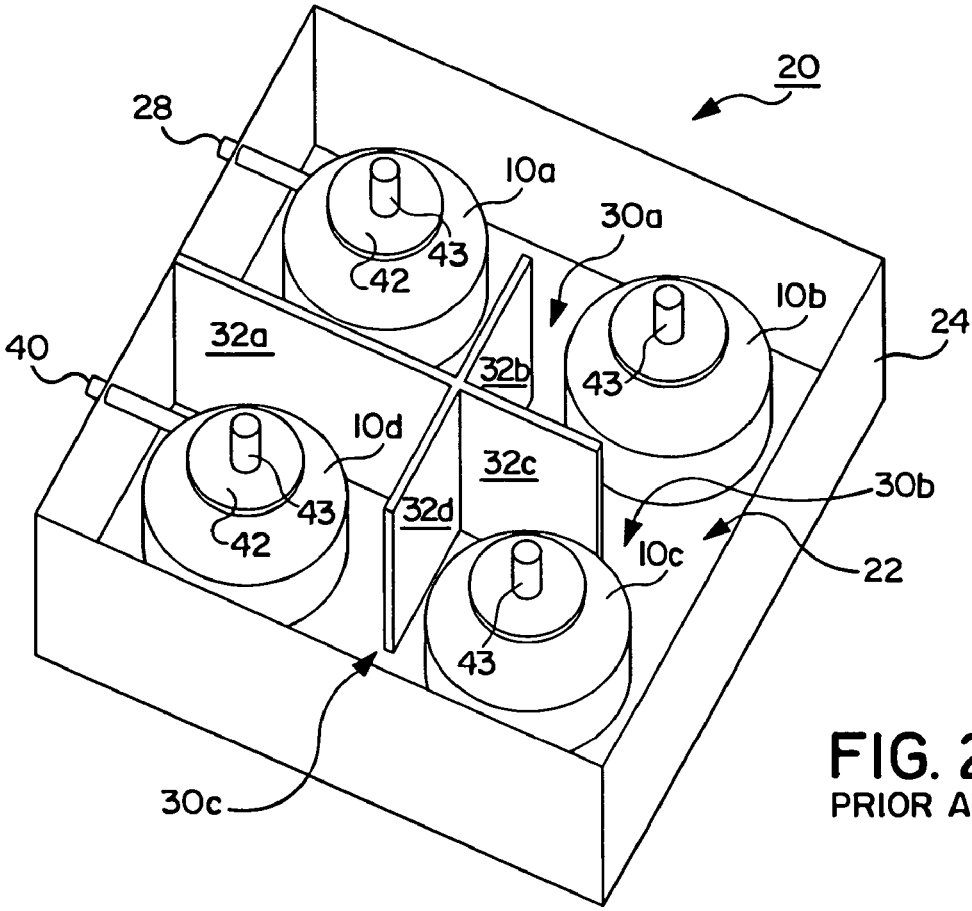
FIG. 2 PRIOR ART
FIG. 2 is a perspective view of an exemplary microwave dielectric resonator filter in accordance with the prior art.
Figure 3:
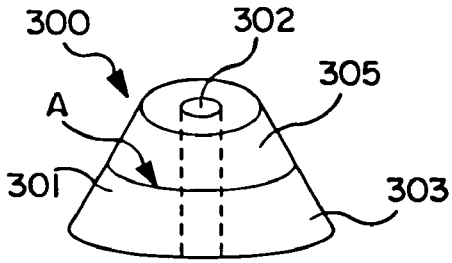
FIG. 3 is a perspective view of a conical dielectric resonator in connection with which use of the present invention is particularly suitable.

FIG. 3 is a perspective view of an exemplary embodiment of a dielectric resonator disclosed in the aforementioned patent application. As shown, the resonator 300 is formed in the shape of a truncated cone 301 with a central, longitudinal through hole 302. This design has many advantages over conventional, cylindrical dielectric resonators, including physical separation of the $H_{11}$ mode from the TE mode and/or almost complete elimination of the $H_{11}$ mode. Specifically, the TE mode electric field tends to concentrate in the base 303 of the resonator while the $H_{11}$ mode electric field tends to concentrate at the top 305 (narrow portion) of the resonator. The longitudinal displacement of these two modes improves performance of the resonator (or circuit employing such a resonator) because the conical dielectric resonators can be positioned adjacent other microwave devices (such as other resonators, microstrips, tuning plates, and input/output coupling loops) so that their respective TE mode electric fields are close to each other and strongly couple, whereas their respective $H_{11}$ mode electric fields remain further apart from each other and, therefore, do not couple to each other nearly as strongly, if at all. Accordingly, the $H_{11}$ mode would not couple to the adjacent microwave device nearly as much as in the prior art, where the TE mode and the $H_{11}$ mode are physically located much closer to each other.

In addition, the mode separation (i.e., frequency spacing) is increased in a conical resonator. Even further, the top of the resonator may be truncated to eliminate the portion of the resonator in which the $H_{11}$ mode field would be concentrated, thereby substantially attenuating the strength of the H11 mode in addition to pushing it upward in frequency away from the TE fundamental mode field.

Techniques for Tuning

The techniques and mechanisms of the present invention largely eliminate the need for irises, tuning screws, and tuning plates in broad band, high frequency dielectric filters and other circuits. Particularly, rather than using extra components (such as tuning screws, tuning plates and walls with irises) to set bandwidth and frequency, the present invention utilizes the energy reservoirs themselves, i.e., the dielectric resonators themselves, to frequency and bandwidth tune the circuit.

Turning first to the matter of bandwidth tuning, it is well known that the bandwidth of a dielectric resonator filter is dictated largely by the coupling strength between the fields generated by the individual dielectric resonators in the filter. Generally, the stronger the coupling between dielectric resonators, the broader the bandwidth of the circuit.

Figure 4:
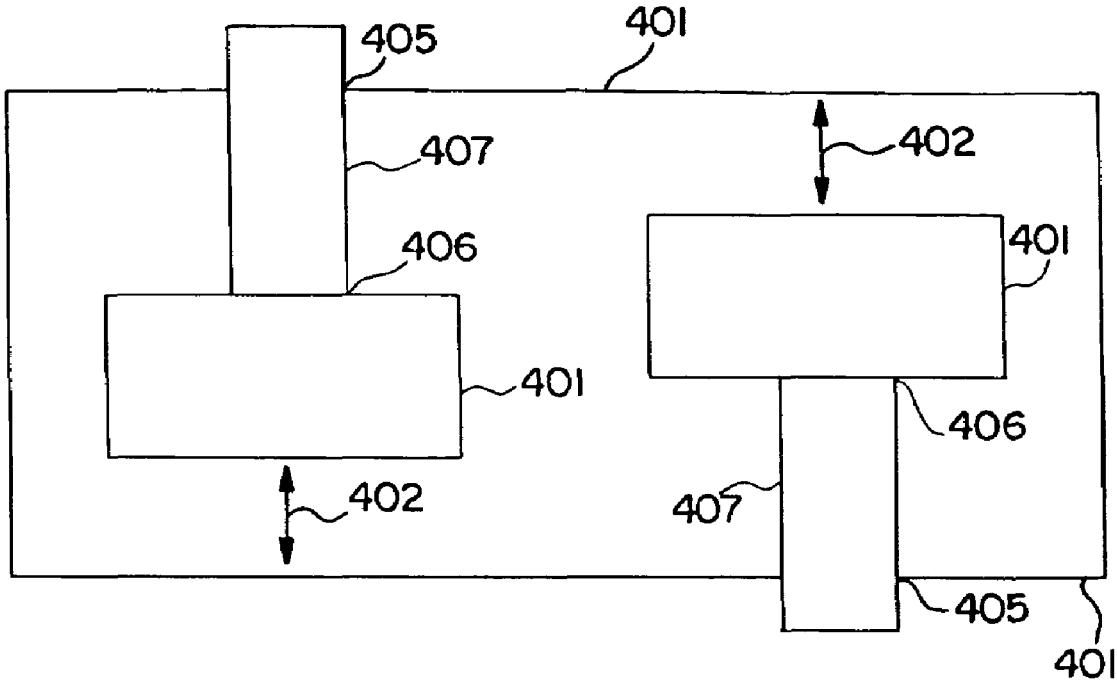
FIG. 4 is a side elevation view of a dielectric resonator filter in accordance with one embodiment of the present invention in which the dielectric resonators are vertically adjustable relative to each other.

FIG. 4 illustrates a first embodiment of the present invention. In this embodiment, the dielectric resonators that electromagnetically couple to each other are vertically adjustable relative to each other. In the context of this application, the term "vertically" refers to the dimension along the longitudinal axis of the dielectric resonators or, alternatively, the direction perpendicular to the lines of the TE mode. Thus, for instance, in FIG. 4, the dielectric resonators 401 are adjustable in the direction of the arrows 402. Many mechanisms could be used to provide the longitudinal adjustability that would be apparent to those of ordinary skill in this art. One particular mechanism would be to mount the dielectric resonator 401 on holding posts, and preferably screws 407, which are screwed into threaded holes 405 in walls 401 of the enclosure. Alternately, the holes 405 can be blind holes. The resonators 403 also may be adjustably mounted on the screws 407. Particularly, the longitudinal central holes 406 in the resonators 401 also may be threaded to mate with the screws 407. Accordingly, by rotating a screw 407 relative to one or both of the corresponding hole 405 in the enclosure 401 or the corresponding longitudinal hole 406 in the resonators 401, the position of the resonator can be easily adjusted longitudinally.

In a preferred embodiment, the resonators are fixedly mounted to the screws and the screws are rotatable only within the holes in the enclosure. If the holes 405 in the enclosure are through holes, the resonator spacing, and thus the bandwidth of the filter, can be adjusted by rotating the screws that protrude from the enclosure without even opening the enclosure 401. Also, since there are no irises, coupling screws, or separating walls between the resonators, and the design of the resonators and the system inherently provides for wide flexibility of coupling between adjacent resonators, a system can be easily designed in which the enclosure 401 plays little or no role in the electromagnetic performance of the circuit. Accordingly, instead of being required to fabricate the housing extremely precisely and out of a conductive material (e.g., metal) in order to provide suitable electromagnetic characteristics, the enclosure can now be fabricated using low-cost molding or casting processes, with lower cost materials and without the need for precision or other expensive milling operations, thus substantially reducing manufacturing costs. In addition, the screws 407 for mounting the resonators in the enclosure also can be made out of a non-conducting material and/or without concern for their effect on the electromagnetic properties of the system.

The screws 407 upon which the resonators are mounted can be coupled to electronically controlled mechanical rotating means (not shown) to remotely tune the filter. For instance, the screws 407 can be remotely controlled to tune the filter using local stepper motors and digital signal processors (DSP) that receive instructions via wired or wireless communication systems. The operating parameters of the filter may be monitored by additional DSPs and even sent via the wired or wireless communication system to a remote location to affirm correct tuning, thus forming a truly remote-controlled servo filter.

Other possibilities for mounting the resonators to the housing include a post positioned with a hole in the housing by a simple friction fit.

The concept of mounting the resonators on adjustable screws as illustrated in FIG. 4 can be applied to conventional, cylindrical dielectric resonators, as shown, but may also be applied in connection with resonators of other shapes, such as conical resonators. It also should be understood that the disclosed mechanisms for providing longitudinal adjustability are merely exemplary and that any reasonable mechanism for permitting the resonators to be adjusted longitudinally would be acceptable.

Figure 5:
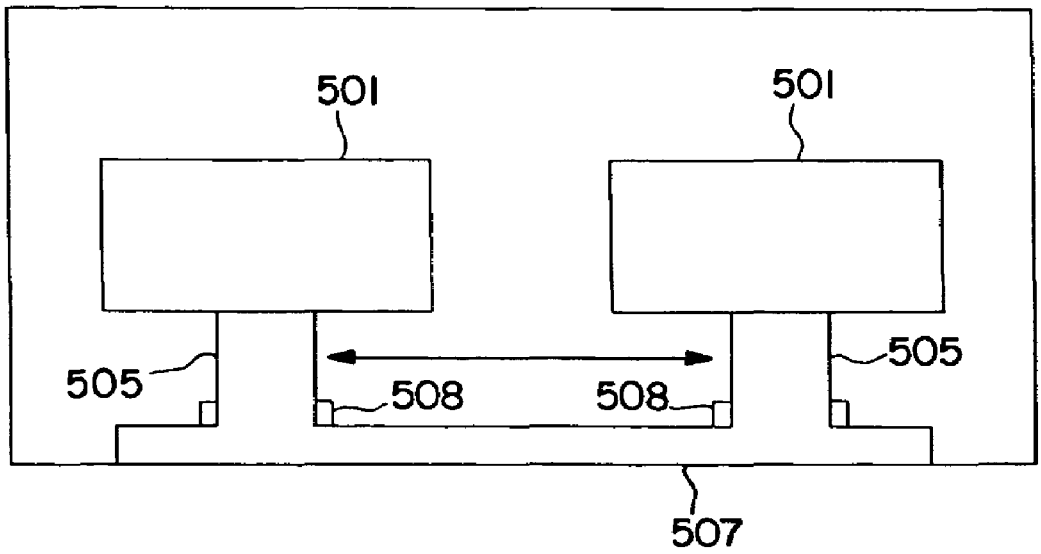
FIG. 5 is a side elevation view of a dielectric resonator filter in accordance with another embodiment of the present invention in which the dielectric resonators are horizontally adjustable relative to each other.

FIG. 5 illustrates a second embodiment of the invention in which the resonators are horizontally adjustable relative to each other. Horizontal adjustability can be provided by any reasonable means. FIG. 5 illustrates embodiment in which the resonators 501 are mounted on posts 505 which, in turn, are mounted on a resonator holder 507. The holder may include one or more slots within which the posts 505 are engaged. The posts may mate with the slots with a frictional fit. Alternatively, the bottoms of the support posts may have radial gears which form a gear assembly with mating gears in the slot. Even more simply, the bottoms of the posts 505 may be threaded and held tightly to the slots by nuts and/or lock washers 508 that can be selectively tightened. When loosened, the posts 505 can move within the slots. When tightened, they become fixed within the slots. Any other reasonable mechanical connection mechanism that allows the posts to slide horizontally and, preferably, then locked in position would be acceptable.

In a preferred embodiment of the invention, both vertical adjustability and horizontal adjustability are provided in a single filter circuit.

Figure 6:
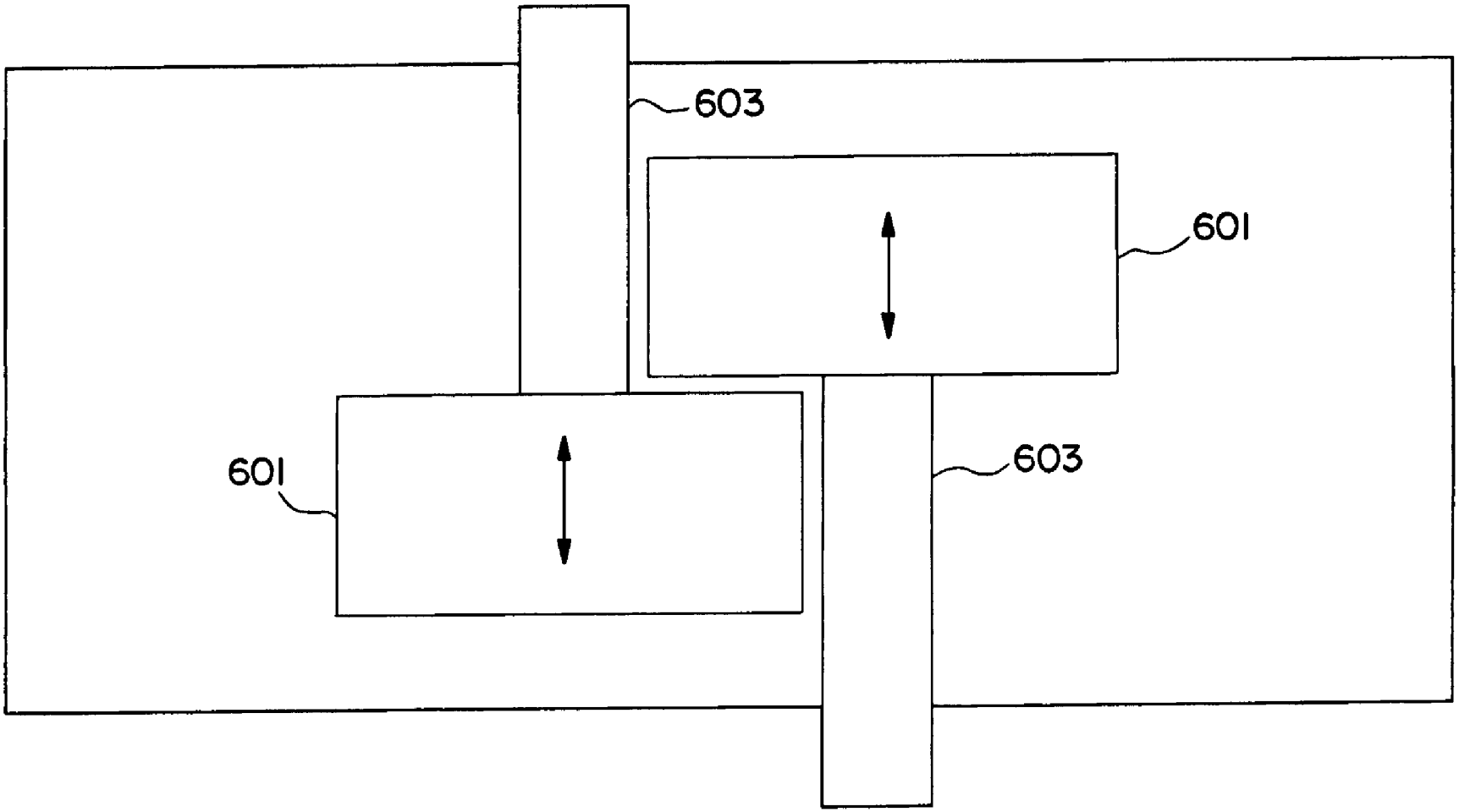
FIG. 6 is a side elevation view of a dielectric resonator in which the dielectric resonators are vertically adjustable relative to each other and vertically overlap each other.

FIG. 6 illustrates another embodiment of the invention in which the resonators 601 are mounted on posts 603 that allow the resonators to be vertically adjusted relative to each other. In this particular embodiment, the resonators 601 are cylindrical resonators and they are vertically offset from each other so that they can overlap each other in a vertical plane (i.e., a plane parallel to the longitudinal axes of the resonators. Embodiments having vertical overlapping resonators are particularly suitable in connection with conical resonators for the reasons discussed in aforementioned U.S. patent application Ser. No. 10/268,415.

Figure 7:
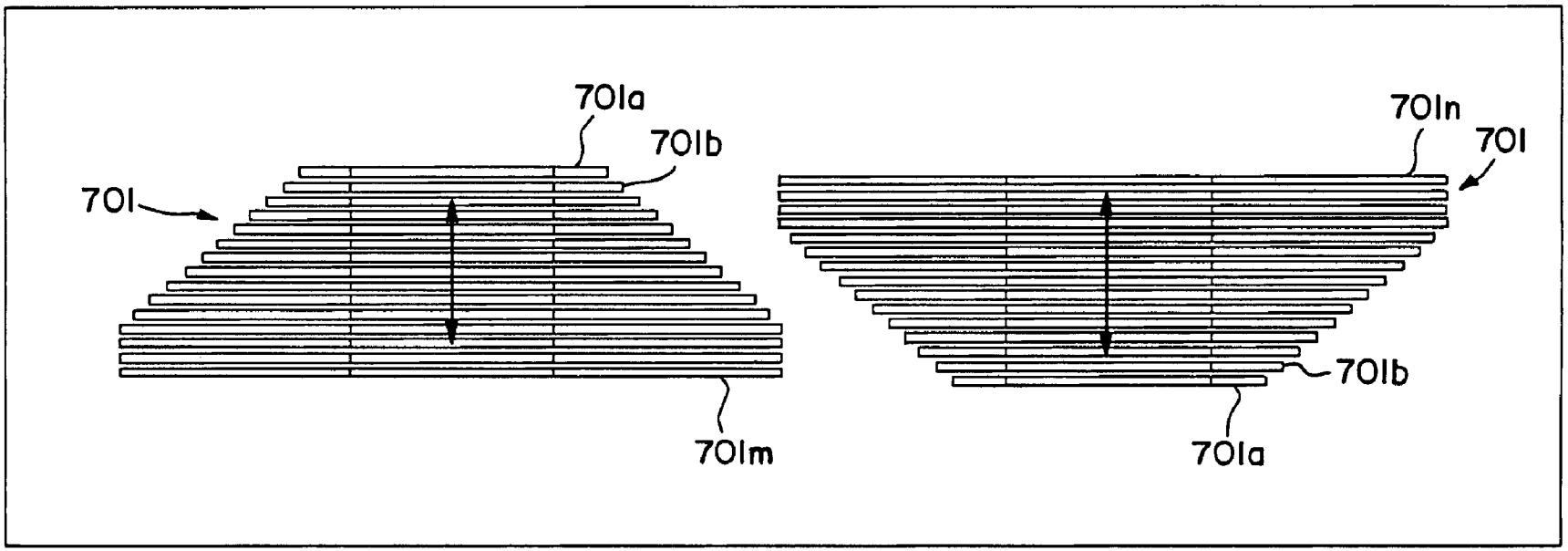
FIG. 7 is a side elevation view of a dielectric resonator filter in which the dielectric resonators are vertically adjustable relative to each other, are conical, are formed of a plurality of layers, and vertically overlap each other.

FIG. 7 illustrates another embodiment of the invention in which the resonators 701 are conical resonators with vertical overlap and vertical adjustability. In this particular embodiment, the resonators 701 comprise multiple laminated layers 701*a*, 701*b*, et seq. In fact, the resonators can be of any shape and can be composed of any number of layers.

Figure 8A:
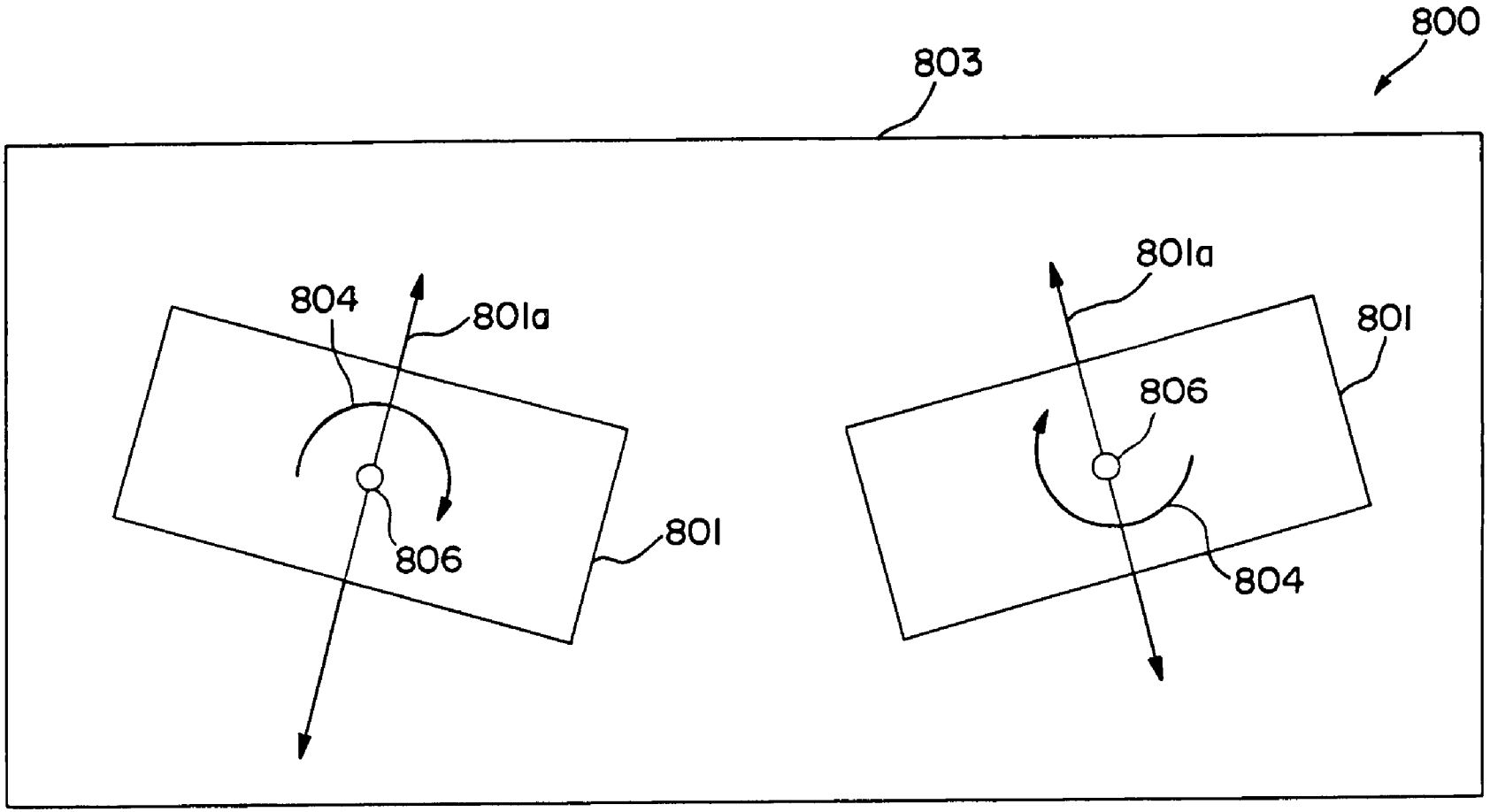
FIGS. 8A-8C are a side elevation view of a dielectric resonator filter in accordance with a further embodiment of the present invention in which the dielectric resonators are adjustable relative to each other by tilting in the elevation plane.

FIG. 8A is a schematic side view illustrating another embodiment of the invention. FIG. 8A illustrates a two-pole resonator circuit 800 comprising two cylindrical resonator pucks 801. However, the concept can be extended to resonators of different shapes and filters having different numbers of poles and dielectric resonator pucks. In this embodiment, the resonators 801 are mounted to the housing 803 so as to be rotatable (or tiltable) in the elevation plane as shown by arrows 804, i.e., such that the longitudinal axes 801*a* of the dielectric resonators are variable relative to each other.

Figure 8B:
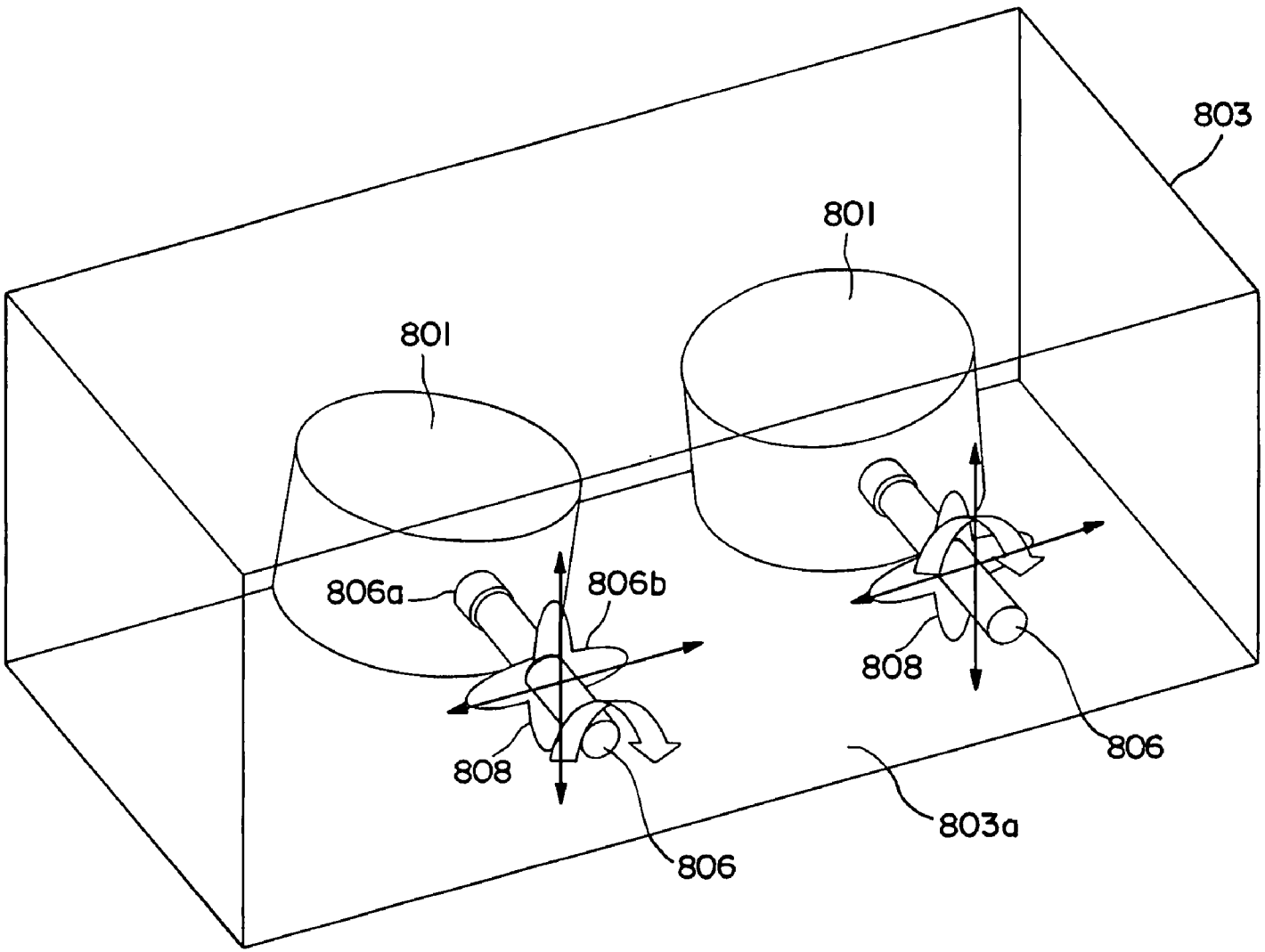

This elevation plane rotation feature can be provided by any reasonable mechanical connection. FIG. 8B is a isometric view of an exemplary dielectric resonator circuit schematically illustrating one scheme that utilizes side posts 806 mounted to the housing wall 803*a*. The post 806 may be mounted to either or both of the puck by a rotatable connection, such as mating threads or frictions fits, as illustrated at 806*a* and 806*b*. Other options include locking nuts and/or washers, mating gear assemblies, etc.

In addition, tilting in the elevation plane may also be combined with the aforementioned vertical and/or horizontal adjustability features illustrated in the embodiments of FIGS. 4 and 5. FIG. 8B, for instance, schematically illustrates an embodiment in which the posts 806 are mounted to the housing in slots 808 that, in addition to permitting the aforementioned tilting, also permit vertical and/or horizontal adjustment.

Figure 8C:
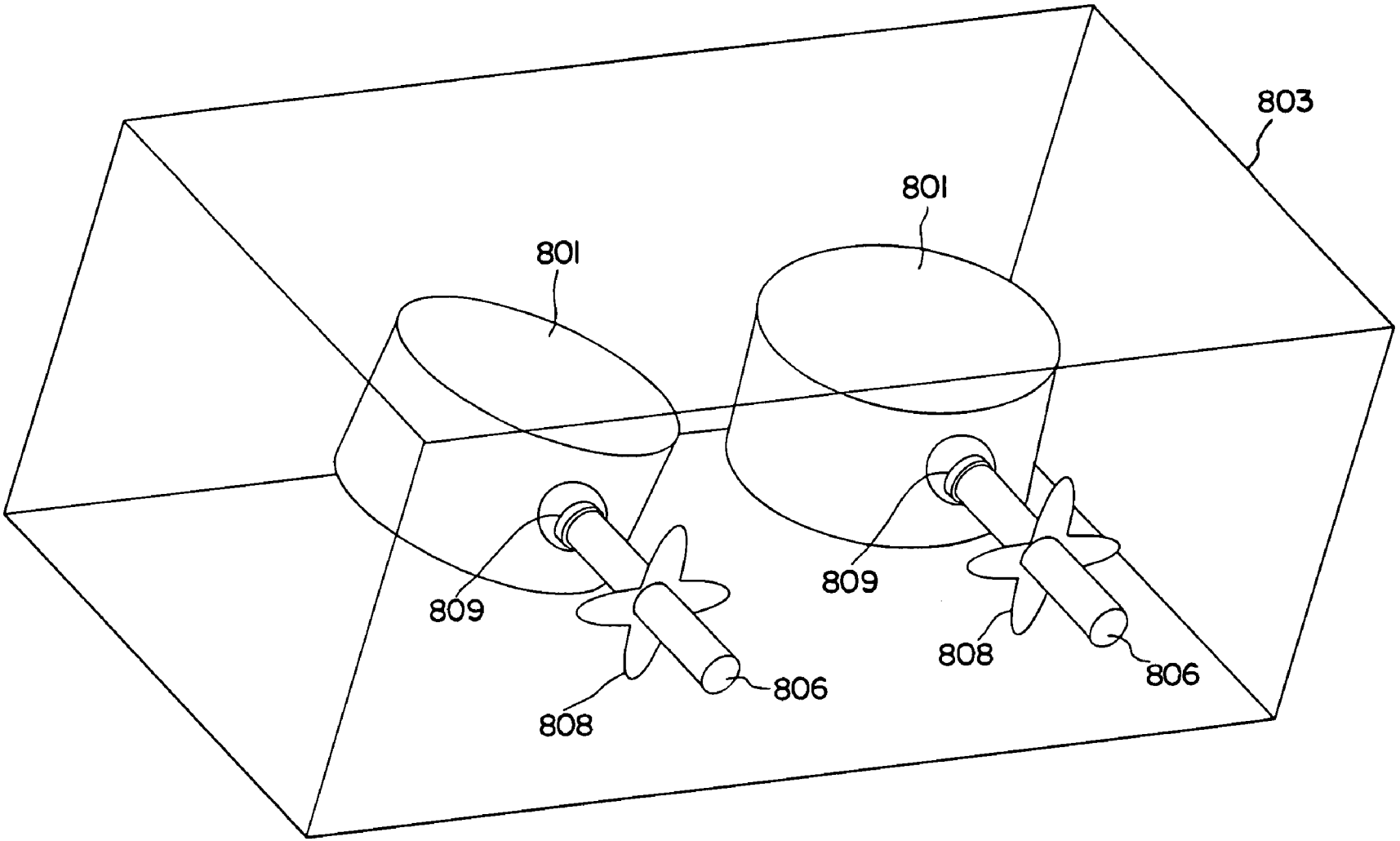

In another preferred embodiment of the invention exemplified by FIG. 8C, the resonator pucks may be mounted by posts 806 with the pucks 801 attached to the ends of the posts by ball joints 809 that permit tilting in all directions. FIG. 8C illustrates side-mounted posts positioned in slots 808 that permit the pucks 801 to also be adjusted vertically and horizontally. However, the posts could be longitudinal, i.e., mounted in the bottom wall 803*b* and projecting upwardly into the resonator pucks with the ball joints positioned in the longitudinal through-hole of the puck (if the puck has one).

FIGS. 9A, 9B, 9C, and 9D illustrate a dielectric resonator filter in which the tilting feature would be particularly suitable. Particularly, FIGS. 9A-9D illustrate a dual mode dielectric resonator filter 900 in which the fundamental modes are two $H_{11}$ modes that are orthogonal to each other. Dual mode filters in which two $H_{11}$ modes are used as the fundamental modes of the filter are known in the art. For instance, dual mode resonator circuits are often used in satellite communication systems. Referring to the isometric view of FIG. 9C, dual mode resonator filters tend to use tall resonators 901 since, for tall resonators, the hybrid $H_{11}$ mode becomes the fundamental mode. Particularly, in accordance with Maxwell's equations, generally, the taller a resonator, the lower the frequency of the $H_{11}$ mode in that resonator. Also, there is one mode, the $H_{11}$ mode, with two polarizations. The circuit of FIGS. 9A-9D has four poles (or modes). A first mode is illustrated by arrow 911 in the first resonator 901*a* in FIG. 9A. This resonator 901*a* has a second $H_{11}$ mode, illustrated by arrow 913, that is orthogonal to the first mode. Likewise, the second resonator 901*b* has a first mode, illustrated by arrow 915, and a second orthogonal $H_{11}$ mode, illustrated by arrow 917. Although the input and output couplers are not illustrated in the drawings (for purposes of clarity), the first mode 911 in the first resonator 901*a* is the input mode, the second mode 913 in the first resonator 901*a* couples through the iris 921 with the first mode 915 of the second resonator 901*b*. The second mode 917 of the second resonator couples to an output coupler (also not shown for purposes of clarity).

Figure 9A:
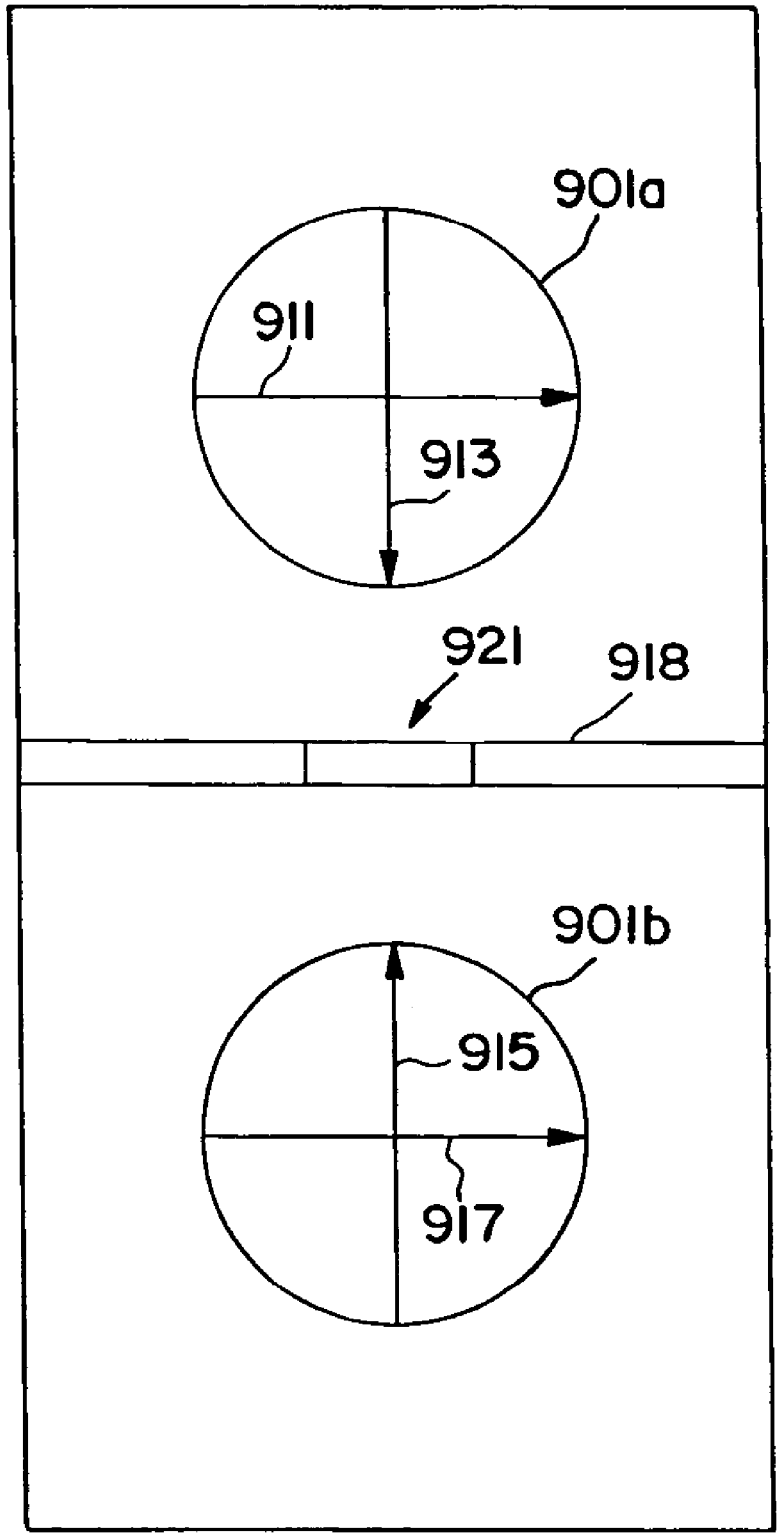
FIG. 9A is a top plan view of a dual mode dielectric resonator filter in accordance with yet another embodiment of the present invention.
Figure 9D:
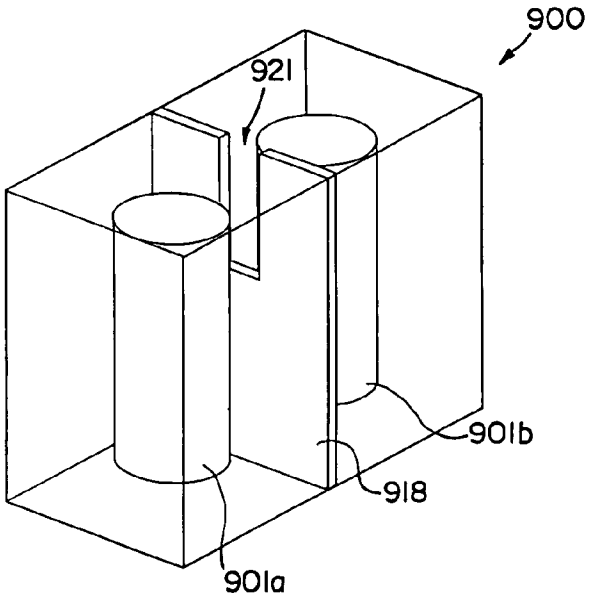
FIG. 9D is a side elevation view of the embodiment of the invention of FIGS. 9A-9C showing the dielectric resonators tilted relative to each other.
Figure 9B:
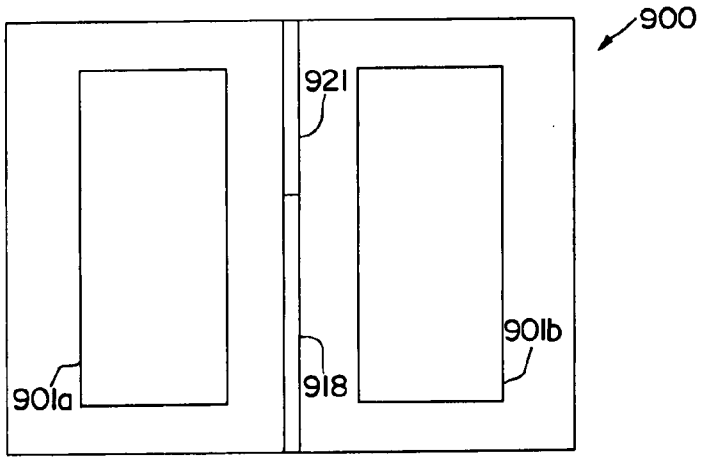
FIG. 9B is an isometric view of the embodiment of the present invention illustrated in FIG. 9A.

As can best be seen in FIG. 9B, the two resonators 901*a* and 901*b* are separated by a separating wall 918 having an iris 921 in its upper half. As is well known in the art, the two orthogonal modes generally will be indistinguishably close to each other in frequency in open space. However, by providing a perturbation in the enclosure, they can be separated from each other in frequency so as to be distinguishable from each other. Again, for purposes of clarity, the perturbation is not shown in the figures, but generally might include one or more conductive posts extending horizontally at a 45° angle from the separating wall 918. The perturbation interacts with the two polarizations causing them to split apart by 90°.

Figure 9C:
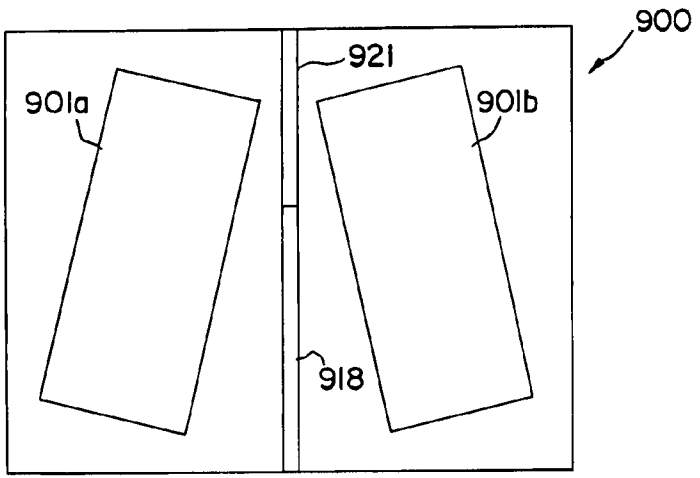
FIG. 9C is a side elevation view of the embodiment of FIGS. 9A and 9B of the present invention showing the dielectric resonators oriented vertically and parallel to each other.

FIG. 9B illustrates the two resonators 901*a* and 901*b* with their longitudinal axes parallel to each other. FIG. 9C illustrates that the coupling strength between the two resonators can be increased by tilting them about the midpoint of their longitudinal axes to move their tops toward each other (i.e., the tops being arbitrarily defined as the ends near the iris). Increasing the coupling strength, of course, will increase the bandwidth of the filter. Generally, although not as a requirement, the tiltability should permit tilting in at least the plane that defines the shortest straight line distance between the two resonators, e.g., the vertical plane perpendicular to the plane of the separating wall in the embodiment of FIGS. 9A-9D. FIGS. 9A-9D do not show the mechanism for permitting tilting, but it may be any of the aforementioned mechanism discussed above in connection with FIG. 8.

Figure 10B:
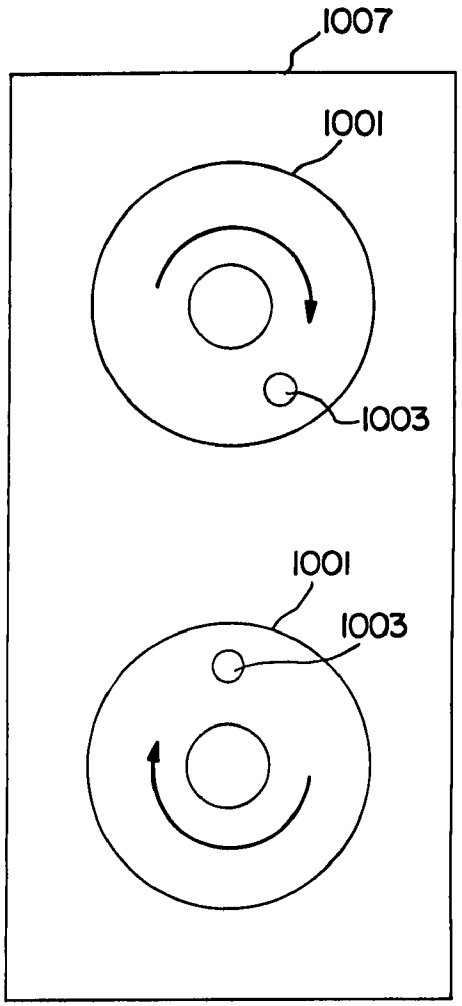
FIGS. 10A and 10B are side elevation and top plan views, respectively, of a dielectric resonator filter in accordance with one more embodiment of the invention in which the dielectric resonators include non-central longitudinal holes and are rotatable about their longitudinal axes.
Figure 10A:
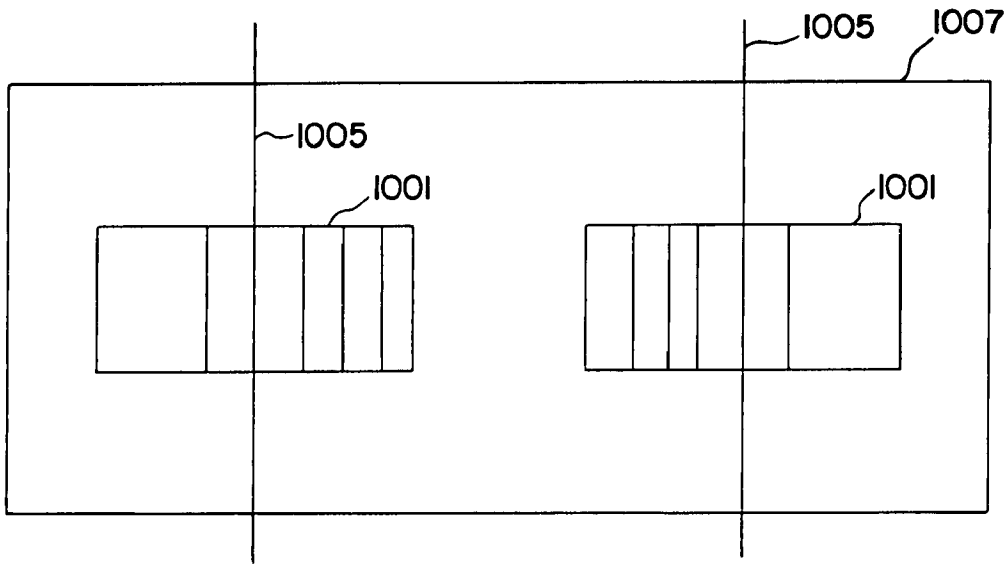

FIGS. 10A and 10B illustrate yet another embodiment of the invention. In this embodiment, a longitudinal hole 1003 is machined in the cylindrical resonators 1001 off-center from the longitudinal axis 1005. This changes the field distribution of the fundamental mode. Particularly, it makes it asymmetric in the horizontal plane. Thus, rotating the resonators 1001 relative to each other about their longitudinal axes 1005 will change the coupling strength because the field is asymmetric in the horizontal plane. Hence, in accordance with another embodiment, the resonators are mounted to the housing 1007 so that one or more of the resonators 1001 is rotatable in the horizontal plane (i.e., about its longitudinal axis). As before, this type of adjustability can be combined with any or all of the aforementioned vertical adjustability, horizontal adjustability, and tilting adjustability in the elevation plane. In fact, the use of a ball joint to provide tilting in the elevation plane would also simultaneously provide rotational adjustability in the horizontal plane.

Figure 11:
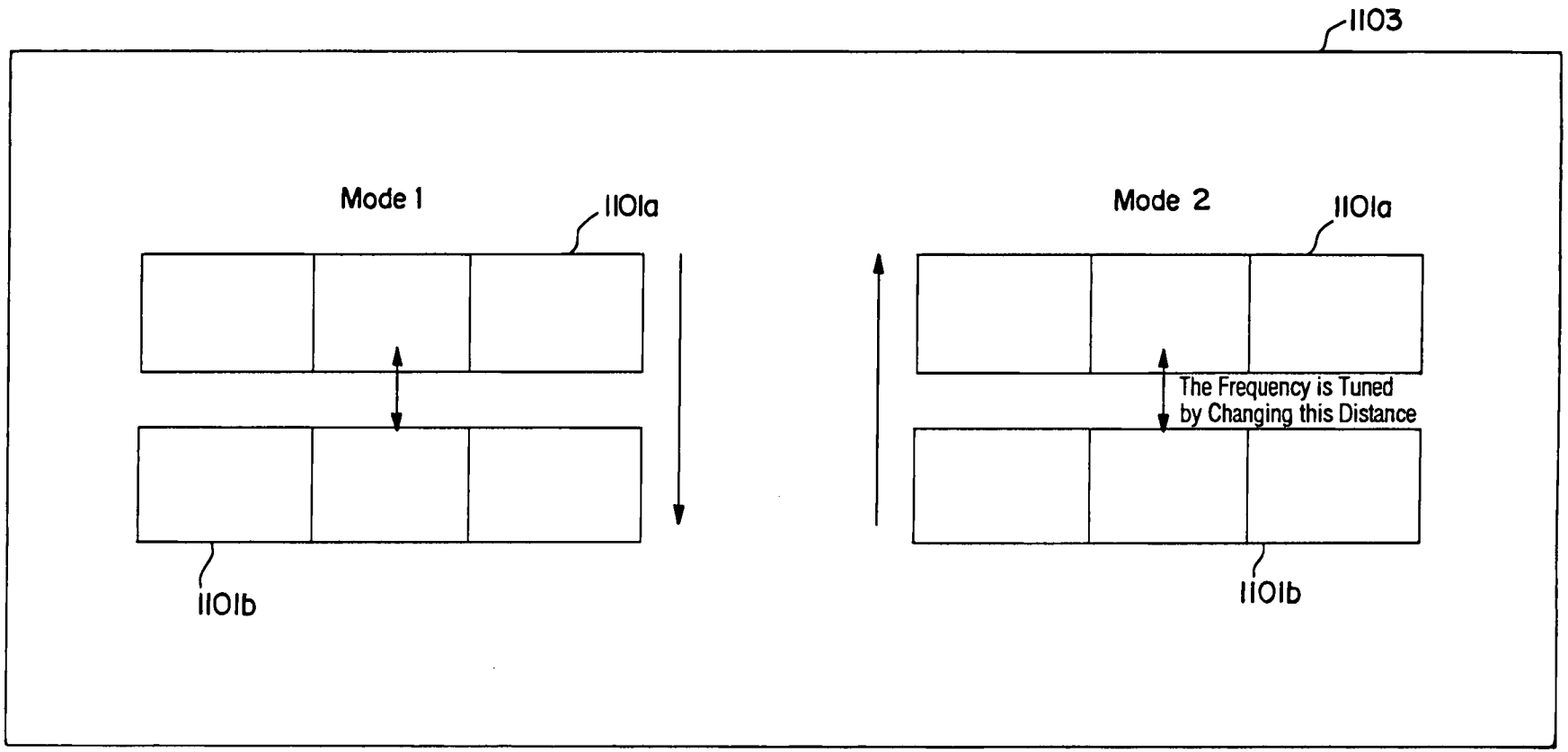
FIG. 11 is a side elevation view of a dielectric resonator filter in accordance with a further embodiment of the invention in which each pole of the filter is established by a pair of adjacent dielectric resonators.

FIG. 11 illustrates another embodiment of the present invention. In this embodiment, each individual resonator puck is replaced by two adjacent pucks 1101*a*, 1101*b* positioned one on top of the other. Although illustrated with two equally sized and shaped resonator pucks 1101*a* and 1101*b*, this aspect of the invention can be applied with resonator pucks of different shapes and sizes than those illustrated and, in fact, each puck in each pair of pucks can be of a different size and/or shape than the other puck in the pair. In accordance with this embodiment of the invention, the two pucks in each puck pair are mounted to the enclosure 1103 so that they can be vertically adjusted relative to each other to increase or decrease their separation from each other. Each pair of pucks corresponds to a mode of the filter. The center frequency of each mode is adjustable by means of changing the separation distance between the two pucks of a puck pair. The longitudinal adjustability can be provided by any of the mechanisms previously discussed as well as any other reasonable mechanisms. Also, this aspect of this invention can be combined with any of the other previously discussed embodiments of the invention in which the bandwidth of the filter can be adjusted by vertically, horizontally, rotationally, or tiltably adjusting each puck pair relative to the other puck pair.

Figure 12B:
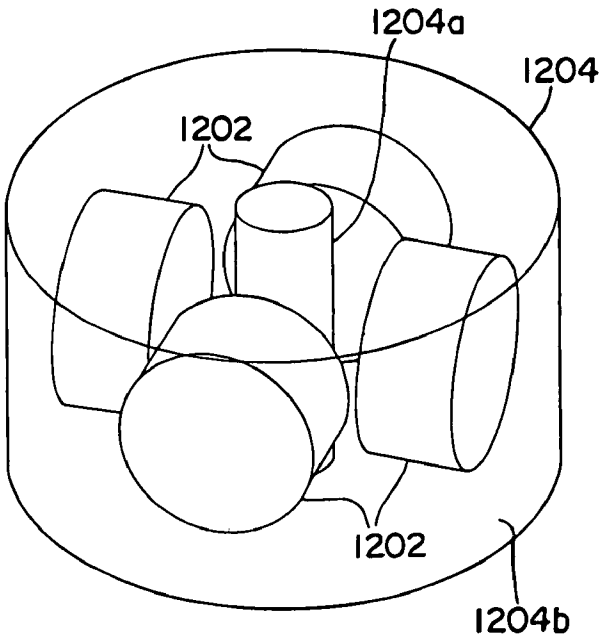
FIGS. 12A and 12B are top plan and isometric views, respectively, of a radial dielectric resonator filter design in accordance with another embodiment of the invention.
Figure 12A:
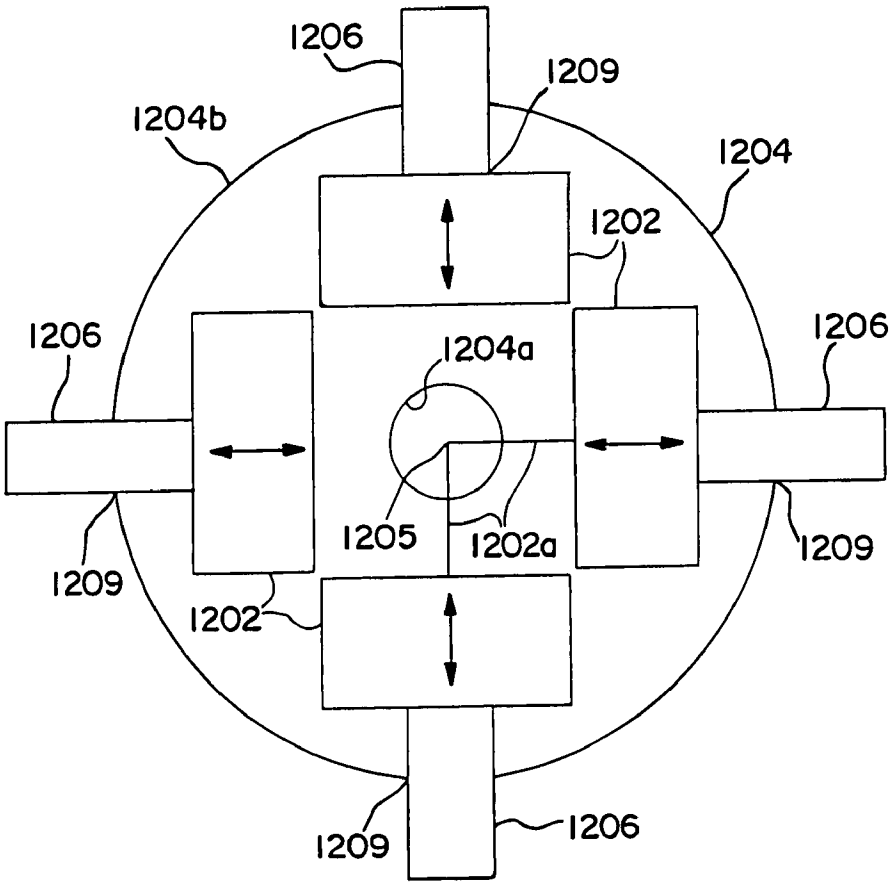

FIGS. 12A and 12B are top-plan and isometric views, respectively, of another embodiment of the invention. This embodiment is a radial embodiment in which the resonator pucks 1202 are arranged in a radial pattern inside a generally cylindrical enclosure 1204. As shown, the cylindrical enclosure is an annulus with an inner radial wall 1204*a* and an outer radial wall 1204*b*. The resonators 1202 are arranged such that their longitudinal axes 1202*a* are substantially in the same plane and intersect at the point 1205 defining the center of the radial pattern (see FIG. 12A). It also includes adjusting screws 1206 (shown only in FIG. 12A) adjustably mounting the resonators 1202 to the enclosure 1204. The screws 1206 are plastic, threaded screws that mate with threaded through holes 1209 in the outer radial side wall 1204*b* of enclosure 1204 so that the positions of the resonators can be adjusted along their longitudinal axes from outside of the enclosure.

Figure 12C:
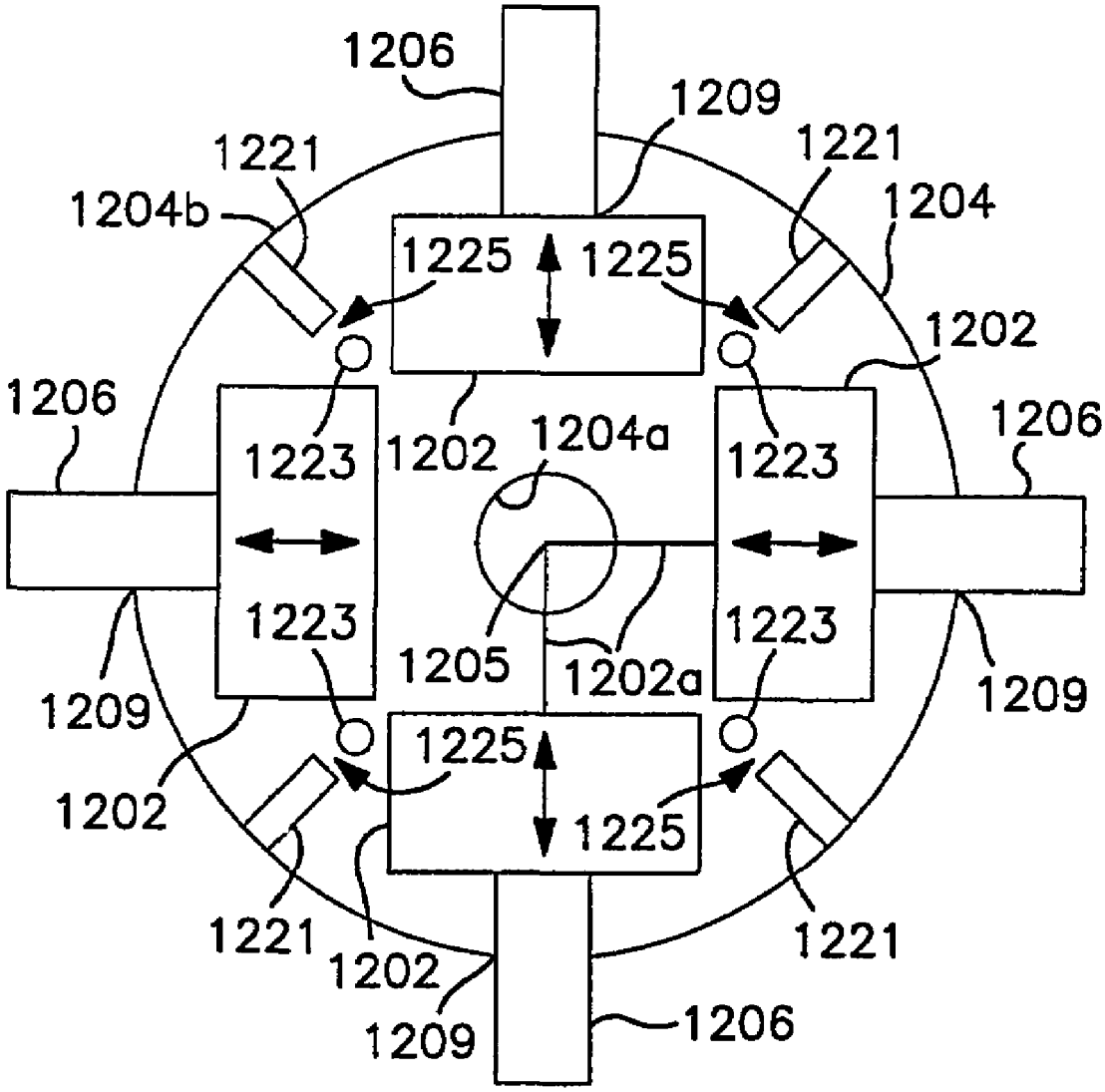
FIG. 12C is a top plan view of another radial dielectric resonator filter designed in accordance with yet another embodiment of the invention.

Since coupling between the resonators in this radial type configuration can be so strong, inner separating walls with irises may be desirable. Further, it may be desirable to have coupling adjusting screws within the irises to further help reduce coupling between resonators. FIG. 12C illustrates such an embodiment similar in design to the embodiment of FIGS. 12A and 12B, but further including inner separating walls 1221 and adjusting screws 1223 in the irises 1225 in the separating walls 1221.

Separating walls with irises and/or adjusting screws would most likely be desirable in filter systems that have relatively low bandwidth. However, for very wide bandwidth applications, in which very strong coupling between the resonators is desired, there may be no need for separating walls and the corresponding irises and adjusting screws.

While the embodiment illustrated in FIGS. 12A and 12B includes four resonators arranged at intervals at 90° and with cylindrical resonators, these features are merely exemplary. A radial dielectric resonator filter system can be developed with any number of resonators at any angular distribution to each other and with conical resonators or resonators of other shapes.

Alternately, the enclosure can be shaped as any equilateral polygon, e.g., a square, a pentagon, a hexagon, an octagon, with an inner wall and an outer wall. In fact, while it would likely be the most practical design, it is not even necessary that the polygon be equilateral. In fact, mathematically, a purely circular annulus is an equilateral polygon having an infinite number of sides. If the enclosure is not an annulus, then the number of sides of each of the inner and outer walls normally should be equal to the number of resonators in the circuit, but again, this is not a requirement.

Having thus described a few particular embodiments of the invention, various other alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example, and not limiting. The invention is limited only as defined in the following claims and equivalents thereto.

We claim:

1. A dielectric resonator circuit comprising:

a housing; and a plurality of dielectric resonators within said housing arranged relative to each other to provide electromagnetic coupling therebetween, wherein said dielectric resonators each have a longitudinal axis defined orthogonal to the field of the fundamental mode of the dielectric resonator and wherein said dielectric resonators are adjustable at least along their longitudinal axes relative to each other and wherein said dielectric resonators are mounted in a radial pattern with their longitudinal axes substantially in the same plane and intersecting at a central point.

2. The dielectric resonator circuit of claim 1 wherein said housing comprises a radial wall and each dielectric resonator is mounted to said housing via a threaded post mounted in a matingly threaded hole in said radial wall, whereby said resonators can be moved along their longitudinal axes by rotation of said posts relative to said housing.

3. The dielectric resonator circuit of claim 2 wherein said holes in said radial wall of said housing are through holes so that said posts may protrude outwardly from said housing.

4. The dielectric resonator circuit of claim 1 wherein said plurality of dielectric resonators comprises four dielectric resonators arranged with their longitudinal axes mutually orthogonal to each other.

5. The dielectric resonator circuit to claim 1 wherein said housing generally defines a hollow cylinder.

6. The dielectric resonator circuit of claim 5 wherein said housing comprises an inner radial wall and an outer radial wall concentric with each other and first and second planar walls joining said inner radial wall to said outer radial wall.

7. The dielectric resonator circuit of claim 1 further comprising separating walls disposed between the dielectric resonators, said separating walls including irises therein.

8. The dielectric resonator circuit of claim 7 further comprising tuning screws disposed in said irises.

* * * * *